US008989628B2

(12) United States Patent
Anderson

(10) Patent No.: US 8,989,628 B2
(45) Date of Patent: Mar. 24, 2015

(54) ENCODER MOUNT

(75) Inventor: Ronald R Anderson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 458 days.

(21) Appl. No.: 13/408,536

(22) Filed: Feb. 29, 2012

(65) Prior Publication Data

US 2013/0223910 A1 Aug. 29, 2013

(51) Int. Cl.

| | |
|---|---|
| ***G03G 15/00*** | (2006.01) |
| ***B41J 13/00*** | (2006.01) |
| ***B41J 15/00*** | (2006.01) |
| ***B41J 11/42*** | (2006.01) |

(52) U.S. Cl.

CPC ..... *B41J 11/42* (2013.01)

USPC ..... 399/167; 400/578

(58) Field of Classification Search

USPC ..... 248/674, 534, 56, 247, 248, 300; 400/578; 399/167

See application file for complete search history.

(56) References Cited

U.S. PATENT DOCUMENTS

| | | | | |
|---|---|---|---|---|
| 3,871,723 | A * | 3/1975 | Pray | 384/495 |
| 5,771,805 | A * | 6/1998 | Branas et al. | 101/248 |
| 2009/0179528 | A1* | 7/2009 | Omura et al. | 310/68 B |
| 2010/0033170 | A1* | 2/2010 | Velasquez et al. | 324/207.25 |

* cited by examiner

*Primary Examiner* — Daniel J Colilla
*Assistant Examiner* — John M Royston

(57) ABSTRACT

A mounting system for an encoder is disclosed. The mounting system prevents rotation about the encoder shaft's axis of rotation. The mounting system allows translation in a plane perpendicular to the encoder shaft's axis of rotation.

15 Claims, 3 Drawing Sheets

ENCODER MOUNT

BACKGROUND

External encoders are used to determine the position and movement of shafts inside a machine or device. Encoders typically produce a stream of encoder pulses as the encoder shaft rotates with respect to the encoder body. There are two general types of external encoders: through shaft designs and ridged mount designs. In general the encoders using the ridged mount designs are typically of higher quality and have better accuracy or higher resolution. Ridged mount designs are attached directly to the device with a ridged mount and use a flexible or compliant coupling between the encoder shaft and the device shaft. Through shaft designs typically use a ridged coupling that attaches the encoder directly to the shaft of the device. A compliant mount couples the encoder body to the side of the device.

Ideally, for both types of encoders, the center of rotation of the encoder will be aligned with the center of rotation of the shaft in the device. But in reality there is always some misalignment between the two different centers of rotation. The compliant coupling between the shafts in the ridged mount encoder and the compliant coupling between the encoder body and the device for the through shaft encoder both compensate for the inherent offset between the center of rotation of the encoder and the center of rotation of the shaft in the device. Compliant designs (compliant shaft coupling for ridged mount, and single compliant tether for through shaft mount) have the disadvantage of inducing small inconsistencies in the encoder pulse stream timing. The inconsistencies manifest themselves as cyclic increases and decreases in encoder pulse timing with each revolution of the encoder due to the geometric limitations of these existing designs.

DETAILED DESCRIPTION

Figure 1:
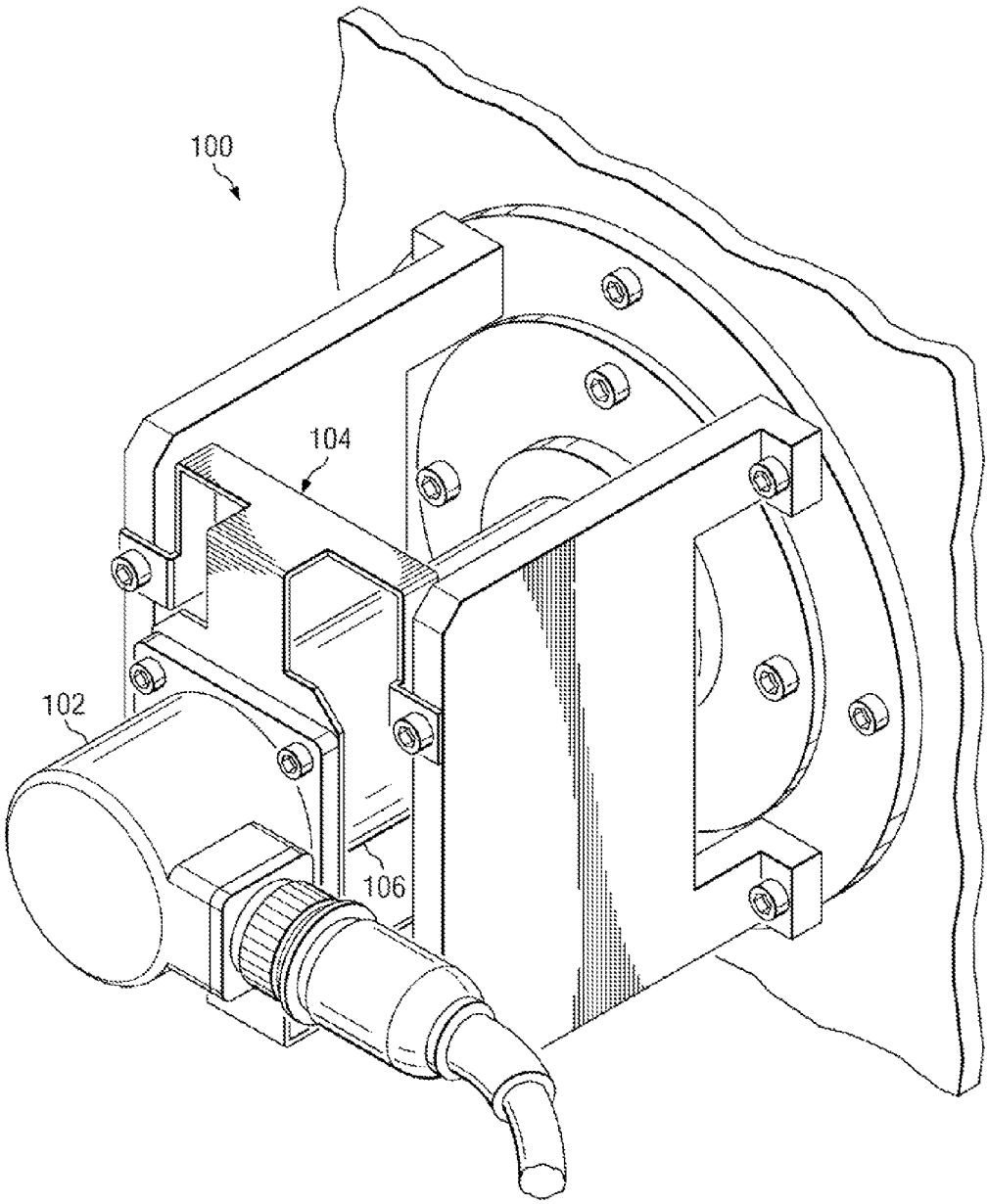
FIG. 1 is an isometric partial view of a ridged mount external encoder attached to a device 100 in an example embodiment of the invention.
Figure 2:
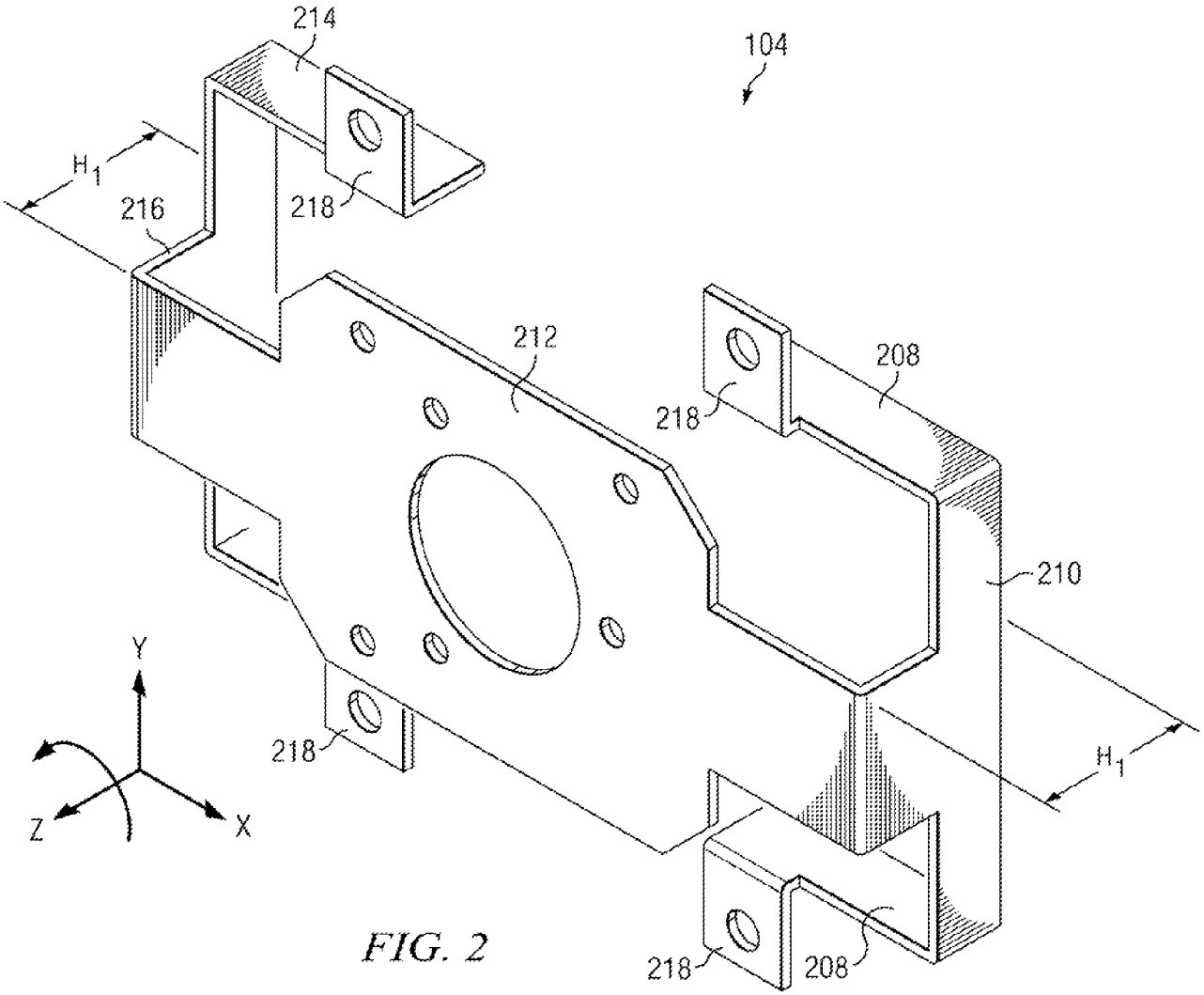
FIG. 2 is an isometric view of bracket 104 in an example embodiment of the invention.
Figure 3:
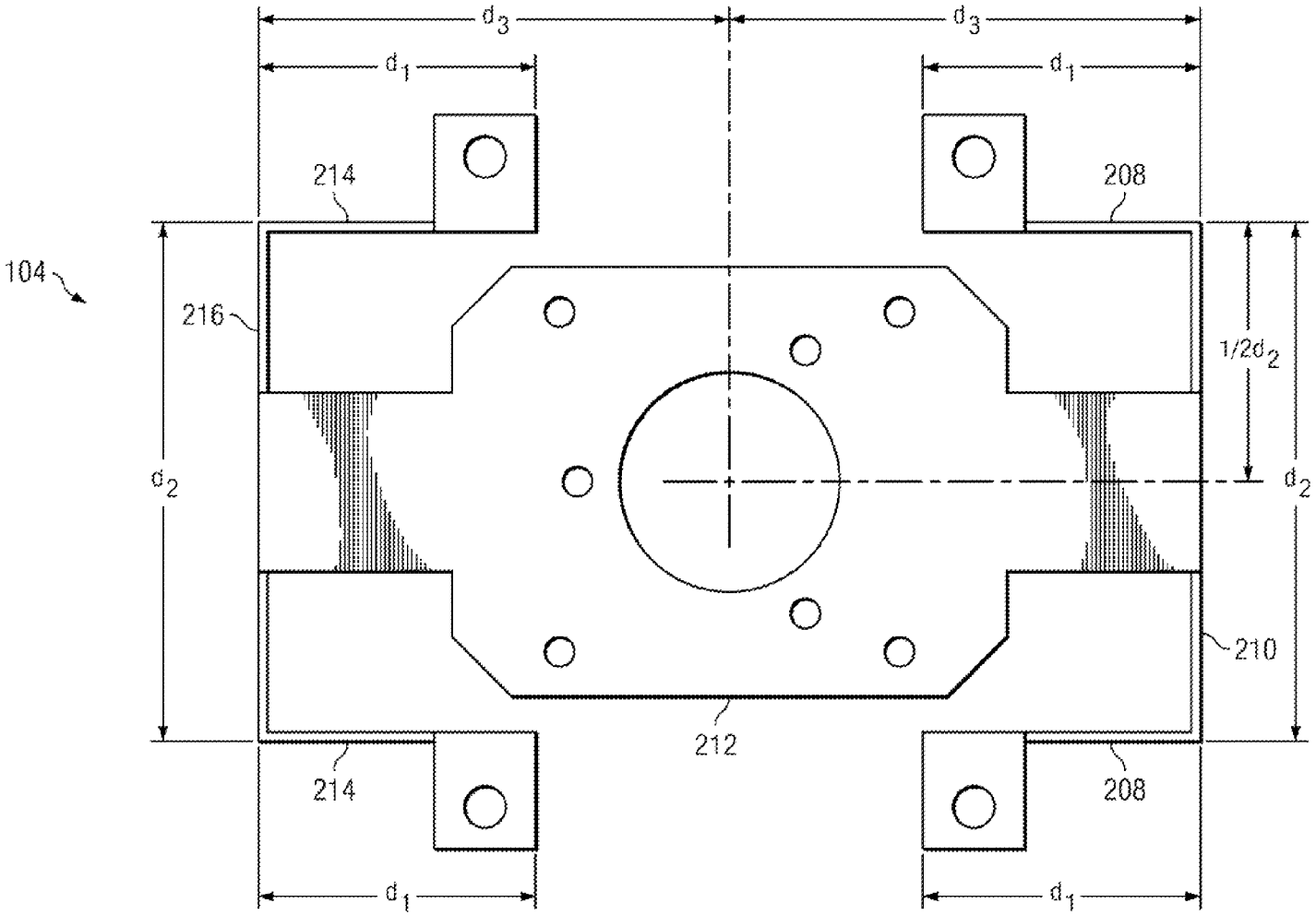
FIG. 3 is a front view of bracket 104 in an example embodiment of the invention.

FIGS. 1-3, and the following description depict specific examples of the invention. For the purpose of teaching inventive principles, some conventional aspects have been simplified or omitted. Those skilled in the art will appreciate variations from these examples that fall within the scope of the invention. The features described below can be combined in various ways to form multiple variations of the invention. As a result, the invention is not limited to the specific examples described below, but only by the claims and their equivalents.

FIG. 1 is an isometric partial view of a external encoder attached to a device 100 in an example embodiment of the invention. FIG. 1 includes the external encoder 102, bracket 104 and a shaft 106 of the device 100 to be measured. The shaft 106 may be in a device that requires accurate positioning and control of the shaft, for example in a printer. Shaft 106 may be part of a paper feeding system in the printer that requires accurate positioning information so that the position of the paper or media can be controller with respect to the print heads of the device. The external encoder 102 is shown as a ridged mount encoder. In other embodiments, the encoder may be a through shaft design.

The shaft of encoder 102 is rigidly coupled to shaft 106 of the device using a coupler. The coupler may be any type of coupler, for example a collar that fits over both shafts and is tightened in place. Bracket 104 is a compliant mounting system that couples the body of the encoder to the device. One part of bracket 104 is rigidly attached to the body of the encoder and another part of bracket 104 is rigidly attached to the device 100. Bracket 104 is compliant and allows translation of the body of the encoder with respect to the device. Bracket only allows translation of the body of the encoder 102 but does not allow rotation of the body of the encoder with respect to the axis of rotation of the shaft of the device. The unique geometry in bracket 104 is compliant in a way that preserves the encoder pulse stream without inducing a cyclic acceleration/deceleration.

FIG. 2 is an isometric view of bracket 104 in an example embodiment of the invention. Bracket 104 comprises: flange 212, a first side beam 210, a second side beam 216, a first pair of legs 208, a second pair of legs 214 and four mounting tabs 218. Bracket 104 is formed from a thin flat plate. Each part of bracket 104 has a front face (FF) and a back face (BF). Bracket 104 has flange 212 as the main section. Flange 212 has mounting holes for mounting the encoder 102. The back face (BF) of flange 212 is visible in FIG. 2. A side beam (210 and 216) is formed at the left and right side of flange 212. The side beams are formed such that the front faces of the two side beams (210 and 216) face each other and are perpendicular to the front face of flange 212. A pair of legs (208 and 214) are attached to the ends of the two side beams (210 and 216). The front faces for each pair of legs face each other and are perpendicular to both the front face of flange 212 and the front faces of the two side beam (210 and 216). A mounting tab 218 is attached to the end of each leg (208 and 214). In other embodiments the mounting tabs 218 may be replaced by mounting holes formed in the end of each of the legs.

A coordinate system can be referenced to bracket 104 with the Z axis perpendicular to flange 212 and the X and Y axis in the plane of flange 212. When the four mounting tabs 218 are attached to a device, bracket 104 prevents rotation of flange 212 around the Z axis. Bracket 104 allows translation in the plane of flange 212 along both the X and Y axis. Each pair of legs (208 and 214) allows translation of side beams (210 and 216) along the Y axis but prevents Z axis rotation. The two side beams allow translation of flange 212 along the X axis but prevent Z axis rotation. Together the bracket allows translation in the plane of flange 212 but prevents rotation around the Z axis.

The encoder 102 has a shaft. When the encoder 102 is mounted to the back face (BF) of flange 212, the shaft sticks through the large mounting hole and aligns with the z axis. Bracket 104 allows translation of the body of the encoder 102 but prevents the body from rotation around the axis of the shaft of the encoder 102. In one example embodiment of the invention, bracket 104 is fabricated from a thin flat plate, for example sheet metal. The thickness of the flat plate may be between 0.01 inches and 0.1 inches thick, for example 0.02 inches thick. The material may be stainless steel, spring steel, or the like, for example T-301 stainless spring steel sheet, ½ hardened. The front faces of each of the parts of bracket 104 are all formed from the same side of the flat plate. The back faces are all formed from the other side of the flat plate.

FIG. 3 is a front view of bracket 104 in an example embodiment of the invention. FIG. 3 shows that in one example embodiment of the invention, all four legs are the same length d1. The side beams are also the same length d2. The main mounting hole is centered in flange 212 with equal lengths between the hole center and the two side beams d3 and equal distance between the hole center and the legs ½ d2. In addition the height of the two side beams H1 are also equal (see FIG. 2).

In the examples above, two side beams are shown, one at each end of flange 212. In other example embodiments of the invention, there may be only one side beam and one pair of legs. In addition, the position of the encoder and the device can be switched with the encoder body attached to the ends of the legs and the device attached to the flange. Other geometries are also possible.

What is claimed is:

1. A mounting system for an encoder, comprising:

a bracket for coupling a body of the encoder to a device, the encoder having a shaft with an axis of rotation;

the bracket formed from a thin flat plate;

the bracket having at least one pair of equal length parallel legs formed from each end of a first side beam, each of the pair of legs having a front face, wherein the front faces of each of the legs face each other and both front faces of the legs are perpendicular to a front face of the first side beam;

the bracket having an angled connection section having a first portion extending from a center of the first side beam in the same plane as the front face of the first side beam and a second portion extending perpendicularly to the first portion;

a flange extending from the second portion of the angled connection section such that a front face of the flange is perpendicular to each front face of the pair of legs;

wherein the bracket is to be attached to the device at each end of the pair of legs; and wherein the encoder body is to be attached to the flange such that the axis of rotation of the shaft is perpendicular to the front face of the flange.

2. The mounting system for an encoder of claim 1, wherein the encoder is a ridged mount encoder.

3. The mounting system for an encoder of claim 1, wherein the shaft of the encoder is to be rigidly coupled to a shaft in the device.

4. The mounting system for an encoder of claim 1, wherein the device is a printer and the shaft is part of a paper feeding system.

5. The mounting system for an encoder of claim 1, wherein the bracket is formed from stainless steel.

6. The mounting system for an encoder of claim 1, wherein the flat plate is between 0.01 inches and .1 inches thick.

7. The mounting system for an encoder of claim 1, wherein the bracket is to attach to the device at each end of the pair of legs and the bracket is to attach to the body of the encoder on the flange.

8. The mounting system for an encoder of claim 1, further comprising:

a second pair of equal length parallel legs formed from each end of a second side beam, each of the second pair of legs having a front face, wherein the front faces of each of the second pair of legs face each other and both front faces of the second pair of legs are perpendicular to a front face of the second side beam; and wherein the flange is formed between the first side beam and the second side beam such that the front face of the second side beam faces the front face of the first side beam.

9. The mounting system for an encoder of claim 8, wherein the length of the at least one pair of legs is equal to the length of the second pair of legs.

10. The mounting system for an encoder of claim 8, wherein a height of the first side beam is equal to a height of the second side beam.

11. A mounting system for an encoder, comprising:

a bracket for attaching a body of the encoder to a device, the encoder having a shaft with an axis of rotation; and the bracket having a flange having a first side and a second side, the first side extending from a first angled connection section to a first side beam and the second side extending from a second angled connection section to a second side beam, wherein the first angled connection section and the second angled connection section have greater flexibility along a plane that is perpendicular to the axis of rotation of the shaft than along the axis of rotation of the shaft to prevent rotation of the body about the axis of rotation of the shaft while allowing the body to translate along the plane perpendicular to the axis of rotation of the shaft.

12. The mounting system for an encoder of claim 11, wherein the bracket has a first pair of parallel legs formed from each end of the first side beam and a second pair of parallel legs formed from each end of the second side beam, wherein the first pair of parallel legs, the first side beam, the second pair of parallel legs, and the second side beam have respective faces that extend along a first dimension;

wherein the first angled connection section has a first portion extending from a center of the first side beam along the first dimension and a second portion extending perpendicularly to the first portion, and wherein the second section extends into the first side of the flange;

wherein the second angled connection section has a third portion extending from a center of the second side beam along the first dimension and a fourth portion extending perpendicularly to the third portion, wherein the fourth portion extends into the second side of the flange; and wherein the flange has a larger width than the first angled connection section and has a larger width than the second angled connection section.

13. The mounting system for an encoder of claim 11, wherein the first angled connection section and the second angled connection section are formed of metal and have sufficiently small thicknesses and sufficiently large widths to enable the flange to prevent rotation of the body about the axis of rotation of the shaft while allowing the body to translate along the plane perpendicular to the axis of rotation of the shaft.

14. A printer comprising:

a paper moving system comprising a shaft, the shaft mounted in a frame;

a ridged mount encoder having a body;

a bracket coupling the body of the encoder to the frame, wherein the bracket has a flange having a first side and a second side, the first side extending from a first angled connection section to a first side beam and the second side extending from a second angled connection section to a second side beam, wherein the first angled connection section and the second angled connection section have greater flexibility along a plane that is perpendicular to the axis of rotation of the shaft than along the axis of rotation of the shaft to prevent rotation of the encoder body about the axis of rotation of the shaft while allowing translation of the body along the plane perpendicular to the axis of rotation of the shaft.

15. The printer of claim 14, wherein the bracket has a first pair of parallel legs formed from each end of the first side beam and a second pair of parallel legs formed from each end of the second side beam, wherein the first pair of parallel legs, the first side beam, the second pair of parallel legs, and the second side beam have respective faces that extend along a first dimension;

wherein the first angled connection section has a first portion extending from a center of the first side beam along the first dimension and a second portion extending perpendicularly to the first portion, and wherein the second section extends into the first side of the flange;

wherein the second angled connection section has a third portion extending from a center of the second side beam along the first dimension and a fourth portion extending perpendicularly to the third portion, wherein the fourth portion extends into the second side of the flange; and wherein the flange has a larger width than the first angled connection section and has a larger width than the second angled connection section.

* * * * *